US010566697B2

(12) United States Patent
Johnson et al.

(10) Patent No.: US 10,566,697 B2
(45) Date of Patent: Feb. 18, 2020

(54) BEAM SHAPING FOR RECONFIGURABLE HOLOGRAPHIC ANTENNAS

(71) Applicants: Mikala C. Johnson, Seattle, WA (US); Bruce Rothaar, Woodinville, WA (US)

(72) Inventors: Mikala C. Johnson, Seattle, WA (US); Bruce Rothaar, Woodinville, WA (US)

(73) Assignee: KYMETA CORPORATION, Redmond, CA (US)

( * ) Notice: Subject to any disclaimer, the term of this patent is extended or adjusted under 35 U.S.C. 154(b) by 325 days.

(21) Appl. No.: 15/722,780

(22) Filed: Oct. 2, 2017

(65) Prior Publication Data

US 2018/0040960 A1 Feb. 8, 2018

Related U.S. Application Data

(63) Continuation of application No. 14/680,843, filed on Apr. 7, 2015, now Pat. No. 9,786,986.

(Continued)

(51) Int. Cl.
*H01Q 13/10* (2006.01)
*H01Q 3/24* (2006.01)

(Continued)

(52) U.S. Cl.
CPC ..... *H01Q 13/10* (2013.01); *H01Q 1/3275* (2013.01); *H01Q 3/24* (2013.01); *H01Q 15/0086* (2013.01);

(Continued)

(58) Field of Classification Search
CPC ..... H01Q 3/46; G01R 29/0821
See application file for complete search history.

(56) References Cited

U.S. PATENT DOCUMENTS 3,202,990 A * 8/1965 Howells ..... H01Q 3/2629 342/381
3,435,453 A * 3/1969 Howard ..... H01Q 21/29 342/383

(Continued)

OTHER PUBLICATIONS

Lipworth, G. et al., "Metamaterial apertures for coherent computational imaging on the physical layer," Journal of the Optical Society of America A; vol. 30, No. 8; pp. 1603-1612; Aug. 2013. (Year: 2013).*

(Continued)

*Primary Examiner* — Bernarr E Gregory
(74) *Attorney, Agent, or Firm* — Womble Bond Dickinson (US) LLP

(57) ABSTRACT

A reconfigurable holographic antenna and a method of shaping an antenna beam pattern of a reconfigurable holographic antenna is disclosed. A baseline holographic pattern is driven onto a reconfigurable layer of the reconfigurable holographic antenna while a feed wave excites the reconfigurable layer. An antenna pattern metric representative of a baseline antenna pattern is received. The baseline antenna pattern is generated by the reconfigurable holographic antenna while the baseline holographic pattern is driven onto the reconfigurable layer. A modified holographic pattern is generated in response to the antenna pattern metric. The modified holographic pattern is driven onto the reconfigurable layer of the reconfigurable holographic antenna to generate an improved antenna pattern.

21 Claims, 12 Drawing Sheets

Related U.S. Application Data

(60) Provisional application No. 61/976,292, filed on Apr. 7, 2014.

(51) Int. Cl.

| | |
|---|---|
| ***H01Q 15/00*** | (2006.01) |
| ***H01Q 1/32*** | (2006.01) |
| ***H01Q 21/06*** | (2006.01) |
| ***H01Q 21/00*** | (2006.01) |
| *H01Q 13/00* | (2006.01) |

(52) U.S. Cl.
CPC ..... *H01Q 21/005* (2013.01); *H01Q 21/065* (2013.01)

(56) References Cited

U.S. PATENT DOCUMENTS 4,097,866 A * 6/1978 Frost ..... H01Q 3/2635 342/380
4,381,508 A * 4/1983 Durboraw, III ..... H01Q 3/2629 342/159
5,369,412 A * 11/1994 Tsujimoto ..... H01Q 3/2629 342/380
6,313,803 B1 * 11/2001 Manasson ..... H01Q 3/46 343/756
6,388,631 B1 * 5/2002 Livingston ..... H01Q 3/24 342/374
6,469,672 B1 * 10/2002 Marti-Canales ... G01R 29/0821 342/360
6,567,046 B2 * 5/2003 Taylor ..... H01Q 21/065 257/E29.336
7,460,084 B2 * 12/2008 Upton ..... H01Q 19/067 343/909

OTHER PUBLICATIONS

Lim, S. et al., "Metamaterial-based electronically controlled transmission-line structure as a novel leaky-wave antenna with tunable radiation angle and beamwidth," IEEE Transactions on Microwave Theory and Tecniques; vol. 52, No. 12; pp. 2678-2690; Dec. 2004. (Year: 2004).*
Palmer, K. M., "Metamaterials make for a broadband breakthrough," Spectrum, IEEE; vol. 49, No. 1; pp. 13-14; Jan. 2012. (Year: 2012).*
Baird, C.A. et al., "Adaptive sidelobe nulling using digitally controlled phase-shifters," IEEE Transactions on Antennas and Propagation; vol. AP-24, No. 5; pp. 638-649; Sep. 1976. (Year: 1976).*
Griffiths, L. J. et al., "An alternative approach to linearly constrained adaptive beamforming"; IEEE Transactions on Antennas and Propagation; vol. AP-30, No. 1; pp. 27-34; Jan. 1982. (Year: 1982).*
Herbordt, W. et al., "Efficient frequency-domain realization of robust generalized sidelobe cancellers," IEEE Workshop on Multimedia Signal Processing; pp. 377-382; year 2001. (Year: 2001).*
Widrow, J. R. et al, "Adaptive noise cancelling:Principles and applications," Proceedings of the IEEE; vol. 63, No. 12; pp. 1692-1716; Dec. 1975. (Year: 1975).*
Checcacci, P. F. et al, "Holographic antennas," IEEE Transactions on Antennas and Propagation; vol. 18, No. 6; pp. 811-813; Nov. 1970. (Year: 1970).*
Fong, B. H., "Scalar and tensor holographic artificial impedance surfaces," IEEE Transactions on Antennas and Propagation; vol. 58, No. 10; pp. 3212-3221; Oct. 2010. (Year: 2010).*
Minatti, G. et al, "Spiral leakywave antennas based on modulated surface impedance," IEEE Transactions on Antennas and Propagation; vol. 59, No. 12; pp. 4366-4444; Dec. 2011. (Year: 2011).*
Minatti, G. et al, "A circularly-polarized isoflux antenna based on anisotropic metasurface," IEEE Transactions on Antennas and Propagation; vol. 60, No. 11; pp. 4998-5009; Nov. 2012. (Year: 2012).*
Podilchak, S. K. et al, "Controlled Leaky Wave Radiation from a Planar Configuration of Width-Modulated Microstrip Lines," IEEE Transactions on Antennas and Propagation; vol. 61, No. 10; pp. 4957-4972; Oct. 2013. (Year: 2013).*
Sievenpipper, D. et al, "A tunable impedance surface performing as a reconfigurable beam steering reflector," IEEE Transactions on Antennas and Propagation; vol. 50, No. 3; pp. 384-390; Mar. 2002. (Year: 2002).*
Costa, F. et al, "An active high-impedance surface for low-profile tunable and steerable antennas," IEEE Antennas and Wireless Propagation Letters; vol. 7; pp. 676-680; year 2008. (Year: 2008).*
Gregoire, D. J. et al, "A low profile electronically-steerable artificial-impedance-surface antenna," 2014 International Conference on Electromagnetics in Advanced Applications (ICEAA); pp. 477-479; IEEE; year 2014. (Year: 2014).*
Matekovits, L. et al, "Tunable periodic microstrip structure on GaAs wafer," Progress in Electromagnetics Research, PIER; vol. 97; pp. 1-10; year 2009. (Year: 2009).*
Johnson, M. et al, "Discrete-dipole approximation model for control and optimization of a holographic metamaterial antenna," Applied Optics; vol. 53, vol. 25; pp. 5791-5799; Optical Society of America; Sep. 2014. (Year: 2014).*
Mailloux, R. J. et al, "Phased array antenna handbook: Second Edition," Artech House, Inc.; Norwood, MA; 2005; ISBN: 1-58053-689-1 (Part I: Chapters 1-4; 241 pages). (Year: 2005).*
Mailloux, R. J. et al, "Phased array antenna handbook: Second Edition," Artech House, Inc.; Norwood, MA; 2005; ISBN: 1-58053-689-1 (Part 2: Chapters 5-8; 274 pages). (Year: 2005).*
Jahromi, M. F., "Optical and Microwave Beamforming for Phased Array Antennas," A thesis presented to the University of Waterloo; Waterloo, Ontario, Canada; year 2008; 149 pages. (Year: 2008).*
M. Elsherbiny et al, "Holographic Antenna Concept, Analysis, and Parameters"; IEEE Transactions on Antennas and Propagation; vol. 52, No. 3; Mar. 2004; pp. 830-839; Digital Object Identifier 10.1109/TAP.2004.824673. (Year: 2004).*

* cited by examiner

BEAM SHAPING FOR RECONFIGURABLE HOLOGRAPHIC ANTENNAS

RELATED APPLICATIONS

This is a continuation of U.S. patent application Ser. No. 14/680,843, filed on Apr. 7, 2015, now U.S. Pat. No. 9,786,986, entitled "Beam Shaping for Reconfigurable Holographic Antennas," which is a non-provisional application that claims priority to U.S. Provisional Application No. 61/976,292 entitled "Sidelobe Cancelation for Holographic Metamaterial Antenna," filed Apr. 7, 2014, both of which are incorporated by reference in their entirety.

TECHNICAL FIELD

This disclosure relates generally to antennas, and in particular to reconfigurable holographic antennas.

BACKGROUND INFORMATION

Consumer and commercial demand for connectivity to data and media is increasing. Improving connectivity can be accomplished by decreasing form factor, increasing performance, and/or expanding the use cases of communication platforms. Transmitters and receivers of wireless data platforms present increased challenges when the transmitter and/or the receiver are moving.

Satellite communication is one context where at least one of the transmitter and receiver may be moving. For example, satellite communication delivery to a residential environment may include a fixed satellite dish and a moving satellite. In an example where satellite communication is delivered to a mobile platform (e.g. automobile, aircraft, watercraft) both the satellite and the mobile platform may be moving. Conventional approaches to address these movements include satellite dishes that may be coupled to mechanically steerable gimbals to point the satellite dish in the correct direction to send/receive the satellite data. However, the form factor of satellite dishes and mechanically moving parts limit the use contexts for these prior solutions, among other disadvantages.

Holographic antennas have been developed that have an advantageous form factor over conventional solutions. Increasing the performance of holographic antennas increases the uses and viability of holographic antennas in certain use-cases.

SUMMARY OF THE INVENTION

A reconfigurable holographic antenna and a method of shaping an antenna beam pattern in the reconfigurable holographic antenna are disclosed. In one embodiment, a method of shaping an antenna beam pattern in a reconfigurable holographic antenna includes driving a baseline holographic pattern onto a reconfigurable layer of the reconfigurable holographic antenna while a feed wave excites the reconfigurable layer. The method also includes receiving an antenna pattern metric representative of a baseline antenna pattern generated by the reconfigurable holographic antenna while the baseline holographic pattern is driven onto the reconfigurable layer. A modified holographic pattern is generated in response to the antenna pattern metric and the modified holographic pattern is driven onto the reconfigurable layer of the reconfigurable holographic antenna to generate an improved antenna pattern.

In one embodiment, a holographic metamaterial antenna includes a waveguide, a metamaterial layer, and control logic. The metamaterial is coupled to the waveguide as a top-lid of the waveguide. The control logic is coupled to drive holographic patterns onto the metamaterial of the holographic metamaterial layer. The control logic is coupled to drive a baseline holographic pattern onto the metamaterial layer while a feed wave propagates through the waveguide. An antenna pattern metric representative of a baseline antenna pattern is received. The baseline antenna pattern is generated by the holographic metamaterial antenna while the baseline holographic pattern is driven onto the metamaterial layer. A modified holographic pattern is generated in response to the antenna pattern metric and the control logic drives the modified holographic pattern onto the metatmaterial layer of the holographic metamaterial antenna.

BRIEF DESCRIPTION OF THE DRAWINGS

Non-limiting and non-exhaustive embodiments of the invention are described with reference to the following figures, wherein like reference numerals refer to like parts throughout the various views unless otherwise specified.

DETAILED DESCRIPTION

Embodiments of a reconfigurable holographic antenna, a communication system that includes a reconfigurable holographic antenna, and a method of shaping an antenna beam pattern of the reconfigurable holographic antenna are described herein. In the following description, numerous specific details are set forth to provide a thorough understanding of the embodiments. One skilled in the relevant art will recognize, however, that the techniques described herein can be practiced without one or more of the specific details, or with other methods, components, materials, etc. In other instances, well-known structures, materials, or operations are not shown or described in detail to avoid obscuring certain aspects.

Reference throughout this specification to "one embodiment" or "an embodiment" means that a particular feature, structure, or characteristic described in connection with the embodiment is included in at least one embodiment of the present invention. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

Figure 1:
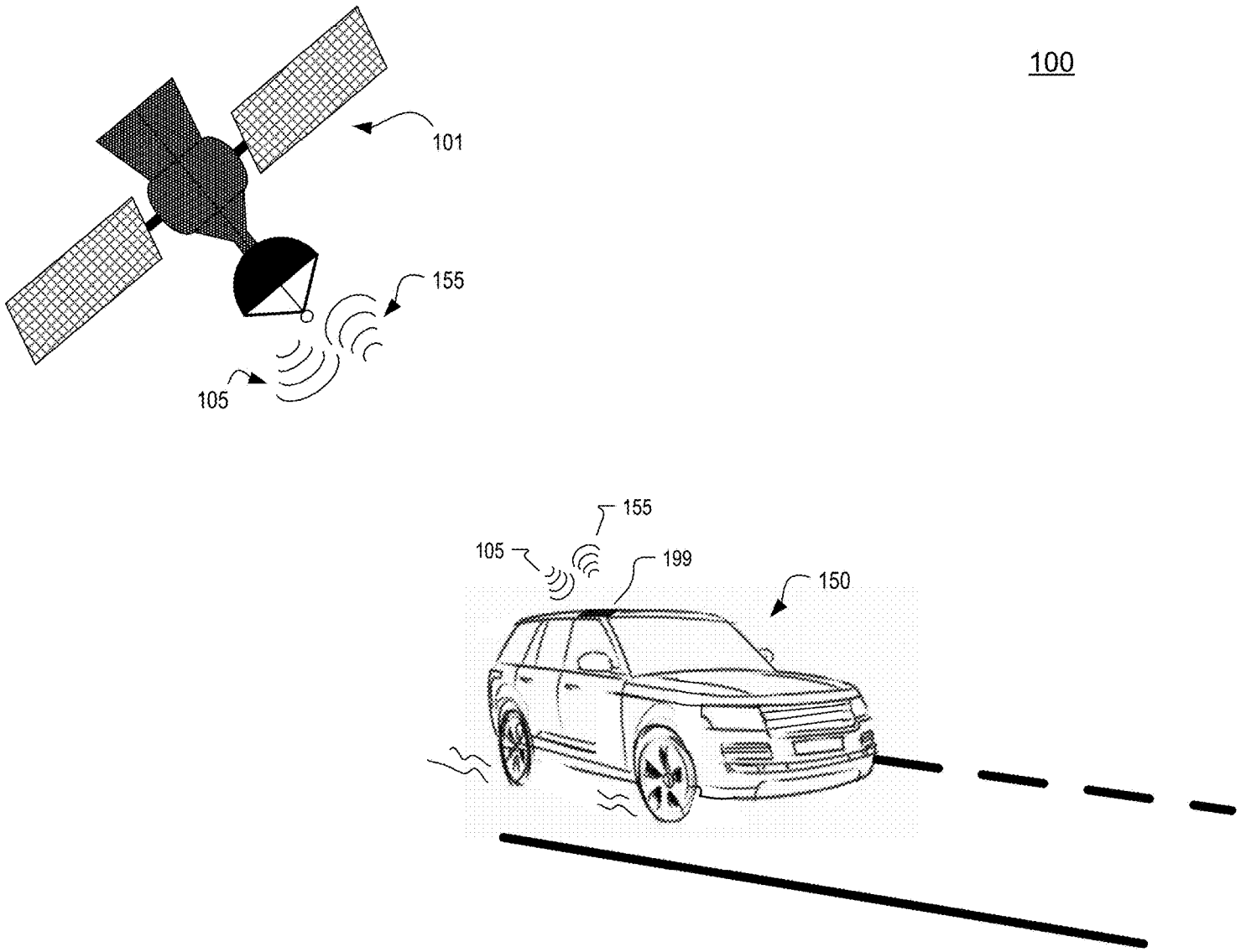
FIG. 1 illustrates a satellite communication system that includes a satellite and a mobile platform that includes a reconfigurable holographic antenna, in accordance with an embodiment of the disclosure.

FIG. 1 illustrates a satellite communication system 100 that includes a satellite 101 and a mobile platform 150 that includes a reconfigurable holographic antenna 199, in accordance with an embodiment of the disclosure. A mobile platform may be an automobile, aircraft, watercraft, or otherwise. Reconfigurable holographic antenna 199 may also be used in a fixed context (e.g. residential satellite television/internet). Satellite 101 includes a satellite antenna that radiates a downlink signal 105 and can receive an uplink signal 155. Mobile platform 150 includes reconfigurable holographic antenna 199 which receives downlink signal 105. Reconfigurable holographic antenna 199 may also transmit an uplink signal 155. Downlink signal 105 and uplink signal 155 may be in the Ka-band frequencies and/or Ku-band frequencies for civil commercial satellite communications, for example.

Reconfigurable holographic antenna 199 uses a reconfigurable layer to form transmit beams (e.g. signal 155) that are directed toward satellite 101 and to steer received beams (e.g. signal 105) to receivers for decoding. In one embodiment, the antenna systems are analog systems, in contrast to antenna systems that employ digital signal processing to electrically form and steer beams (such as phased array antennas). Reconfigurable holographic antenna 199 may be considered a "surface" antenna that is planar and relatively low profile, especially when compared to conventional satellite dish receivers.

Figure 2A:
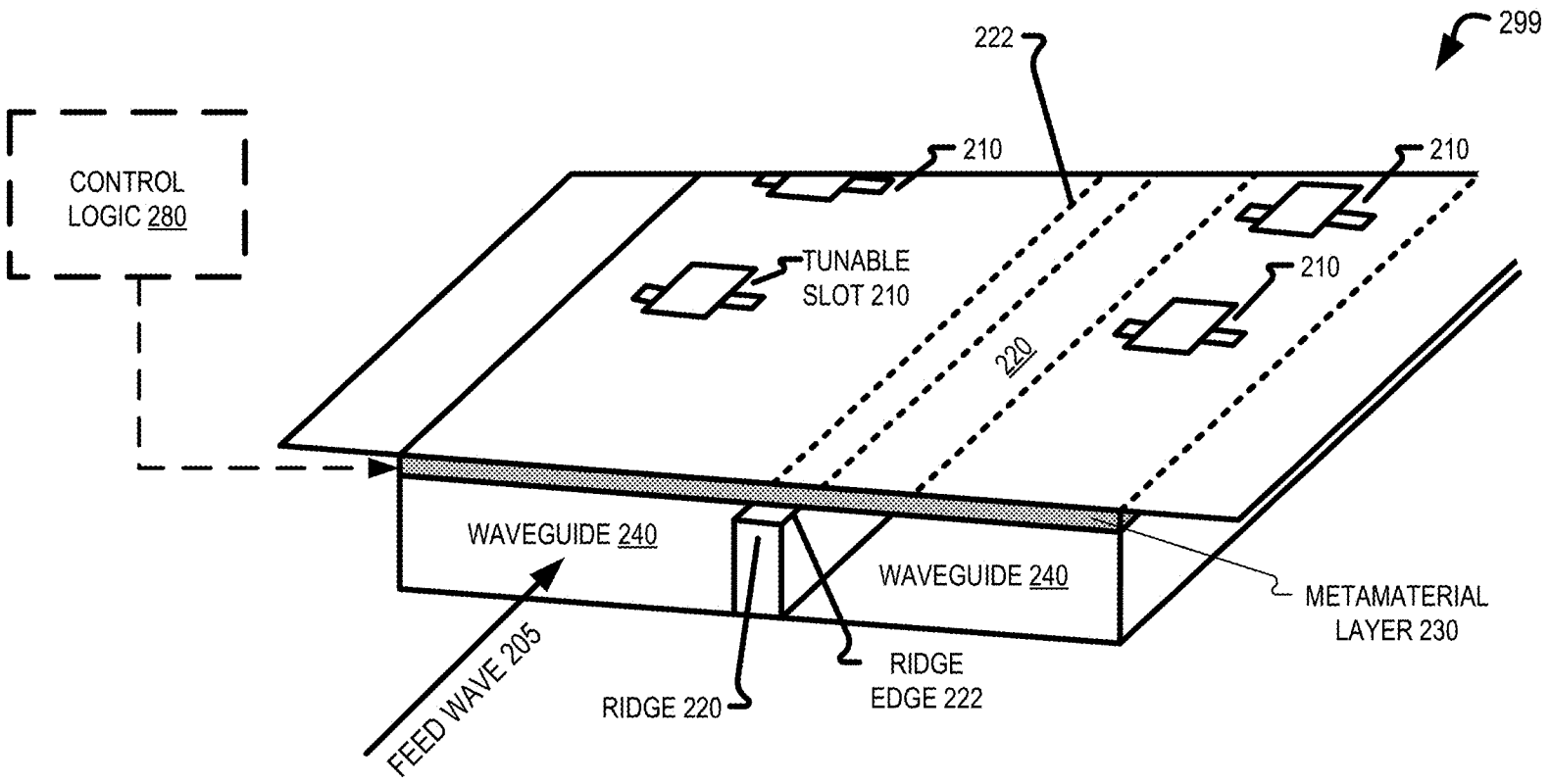
FIG. 2A illustrates a perspective view of a reconfigurable holographic antenna that includes a ridge, in accordance with an embodiment of the disclosure.

FIG. 2A illustrates a perspective view of a reconfigurable holographic antenna 299 that includes a waveguide 240 and a metamaterial layer 230. Waveguide 240 includes a ridge 220 in the illustrated embodiment, but the teachings of the disclosure can be utilized in waveguides that don't include optional ridge 220. Metamaterial layer 230 includes an array of tunable slots 210. The array of tunable slots 210 can be configured to form holographic diffraction patterns that "steer" a feed wave 205 in a desired direction. To effect the holographic diffraction patterns, a reactance of each of the tunable slots can be tuned/adjusted by tuning a tunable dielectric within the tunable slot. In one embodiment, metamaterial layer 230 includes liquid crystal as the tunable dielectric and tuning the reactance of each of the tunable slots 210 includes varying a voltage across the liquid crystal. The elemental design and spacing of tunable slots 210 makes layer 230 a "metamaterial" layer because the layer as a whole provides an "effective medium" that feed wave 205 sees as a continuous refractive index without causing perturbations to the phase of feed wave 205. Consequently, metamaterial layer 230 and waveguide 240 are dimensioned to be many wavelengths (of feed wave 205) in length in FIG. 2A.

Control module 280 is coupled to metamaterial layer 230 to modulate the array of tunable slots 210 by varying the voltage across the liquid crystal in FIG. 2A. Control module 280 may include a Field Programmable Gate Array ("FPGA"), a microprocessor, or other processing logic. Control module 280 may include logic circuitry (e.g. multiplexor) to drive the array of tunable slots 210. Control module 280 may be embedded on printed circuit boards within metamaterial layer 230. Control module 280 may receive data that includes specifications for the holographic diffraction pattern to be driven onto the array of tunable slots 210. The holographic diffraction patterns may be generated in response to a spatial relationship between the reconfigurable holographic antenna and a satellite so that the holographic diffraction pattern steers downlink beam 105 and uplink beam 155 in the appropriate direction for communication.

Optical holograms generate an "object beam" (often times an image of an object) when they are illuminated with the original "reference beam." Radio Frequency ("RF") holography is also possible using analogous techniques where a desired RF beam can be generated when an RF reference beam encounters an RF holographic diffraction pattern. In the case of satellite communications, the reference beam is in the form of a feed wave, such as feed wave 205 (approximately 20 GHz. in some embodiments). To "steer" a feed wave (either for transmitting or receiving purposes), a baseline holographic pattern is calculated between the desired RF beam (the object beam) and the feed wave (the reference beam). The baseline holographic pattern is driven onto the array of tunable slots 210 as a diffraction pattern so that the feed wave is "steered" into the desired RF beam (having the desired shape and direction). In other words, the feed wave encountering the holographic diffraction pattern "reconstructs" the object beam, which is formed according to design requirements of the communication system.

Figure 2B:
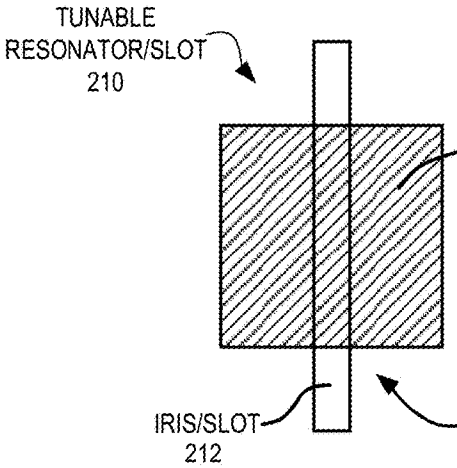
FIG. 2B illustrates a tunable resonator for use in a reconfigurable holographic antenna, in accordance with an embodiment of the disclosure.

FIG. 2B illustrates a tunable resonator/slot 210, in accordance with an embodiment of the disclosure. Tunable slot 210 includes an iris/slot 212, a radiating patch 211, and liquid crystal 213 disposed between iris 212 and patch 211. Radiating patch 211 is co-located with iris 212.

Figure 2C:
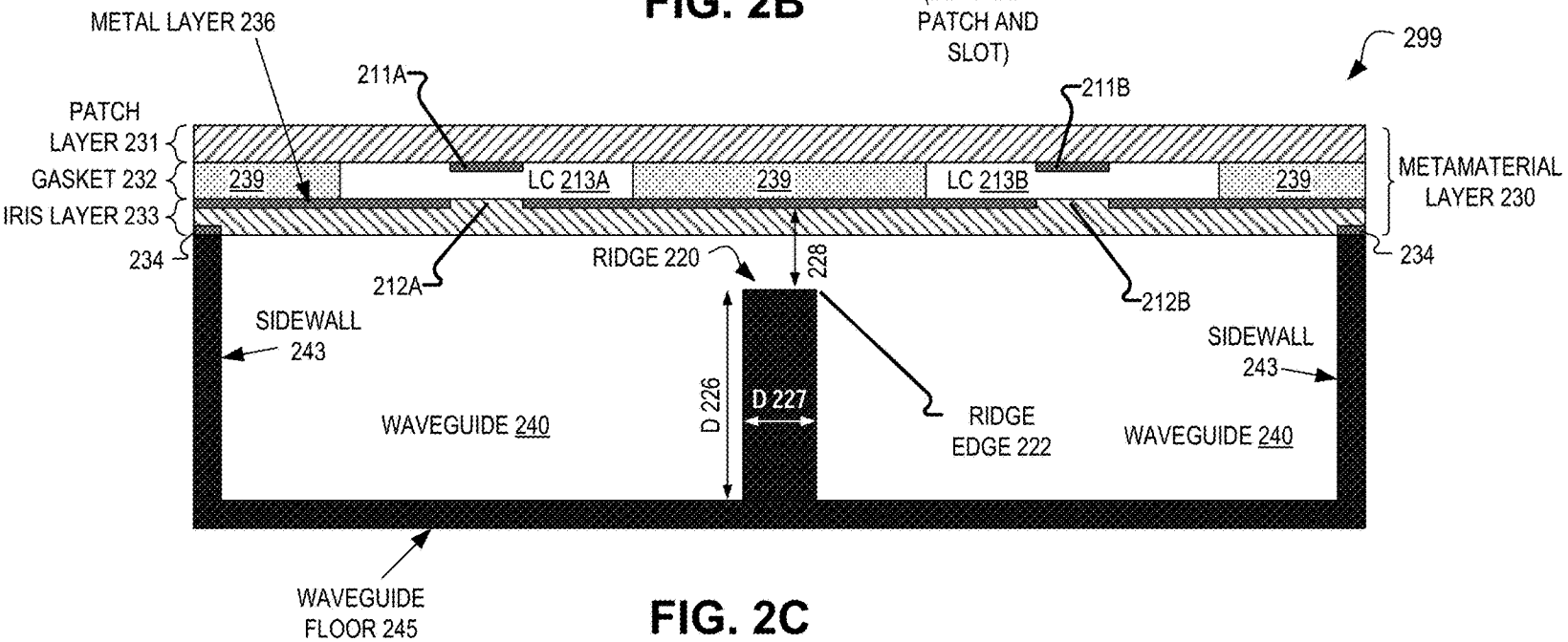
FIGS. 2C-2D illustrate different views of a reconfigurable holographic antenna that includes a ridge, in accordance with an embodiment of the disclosure.

FIG. 2C illustrates a cross section view of example reconfigurable holographic antenna 299, in accordance with an embodiment of the disclosure. Waveguide 240 is bound by waveguide sidewalls 243, waveguide floor 245, ridge 220, and a metal layer 236 within iris layer 233, which is included in metamaterial layer 230. Iris/slot 212 is defined by openings in metal layer 236. Feed wave 205 may have a microwave frequency compatible with satellite communication channels. Waveguide 240 is dimensioned to efficiently guide feed wave 205.

Metamaterial layer 230 also includes gasket layer 232 and patch layer 231. Gasket layer 232 is disposed between patch layer 231 and iris layer 233. Iris layer 233 may be a printed circuit board ("PCB") that includes a copper layer as metal layer 236. Openings may be etched in the copper layer to form slots 212. Iris layer 233 is conductively coupled to waveguide 240 by conductive bonding layer 234, in FIG. 2C. Conductive bonding layer 234 may be conductively coupled to metal layer 236 by way of a plurality of vias and/or metal layers that function to continue the sidewalls 253 up to metal layer 236. Other conductive bonding layers within the disclosure may be similarly coupled to their respective metal layers. Patch layer 231 may also be a PCB that includes metal as radiating patches 211. Gasket layer 232 includes spacers 239 that provide a mechanical standoff to define the dimension between metal layer 236 and patch 211. Spacers 239 are 125 microns tall in one embodiment although spacers 239 may be shorter in other embodiments. Tunable resonator/slot 210A includes patch 211A, liquid crystal 213A, and iris 212A. Tunable resonator/slot 210B includes patch 211B, liquid crystal 213B and iris 212B. The chamber for liquid crystal 213 is defined by spacers 239, iris layer 233, and metal layer 236. When the chamber is filled with liquid crystal, patch layer 231 can be laminated onto spacers 239 to seal liquid crystal within metamaterial layer 230.

A voltage between patch layer 231 and iris layer 233 can be modulated to tune the liquid crystal within the slots 210. Adjusting the voltage across liquid crystal 213 changes the orientation of liquid crystal 213 within the chamber, which in turn varies the capacitance of slot 210. Accordingly, the reactance of slot 210 can be varied by changing the capacitance. Resonant frequency of slot 210 also changes according to the equation $$\omega = \frac{1}{\sqrt{LC}}$$

where ω is the resonant frequency of slot 210 and L and C are the inductance and capacitance of slot 210, respectively. The resonant frequency of slot 210 affects the energy radiated from feed wave 205 propagating through the waveguide. As an example, if feed wave 205 is 20 GHz., the resonant frequency of a slot 210 may be adjusted (by varying the capacitance) to 17 GHz. so that the slot 210 couples substantially no energy from feed wave 205. Or, the resonant frequency of a slot 210 may be adjusted to 20 GHz. so that the slot 210 couples energy from feed wave 205 and radiates that energy into free space. Although the examples given are digital (fully radiating or not radiating at all), full grey scale control of the reactance, and therefore the resonant frequency of slot 210 is possible with voltage variance over an analog range. Hence, the energy radiated from each slot 210 can be finely controlled so that detailed holographic diffraction patterns can be formed by the array of tunable slots. In one example, the grey scale has eight levels for each slot 210.

Sidewalls 243, waveguide floor 245, and ridge 220 may be a contiguous structure. In one embodiment, an extruded metal (e.g. extruded aluminum) forms the contiguous structure. Alternatively, the contiguous structure may be milled/machined from solid metal stock. Other techniques and materials may be utilized to form the contiguous waveguide structure.

Figure 2D:
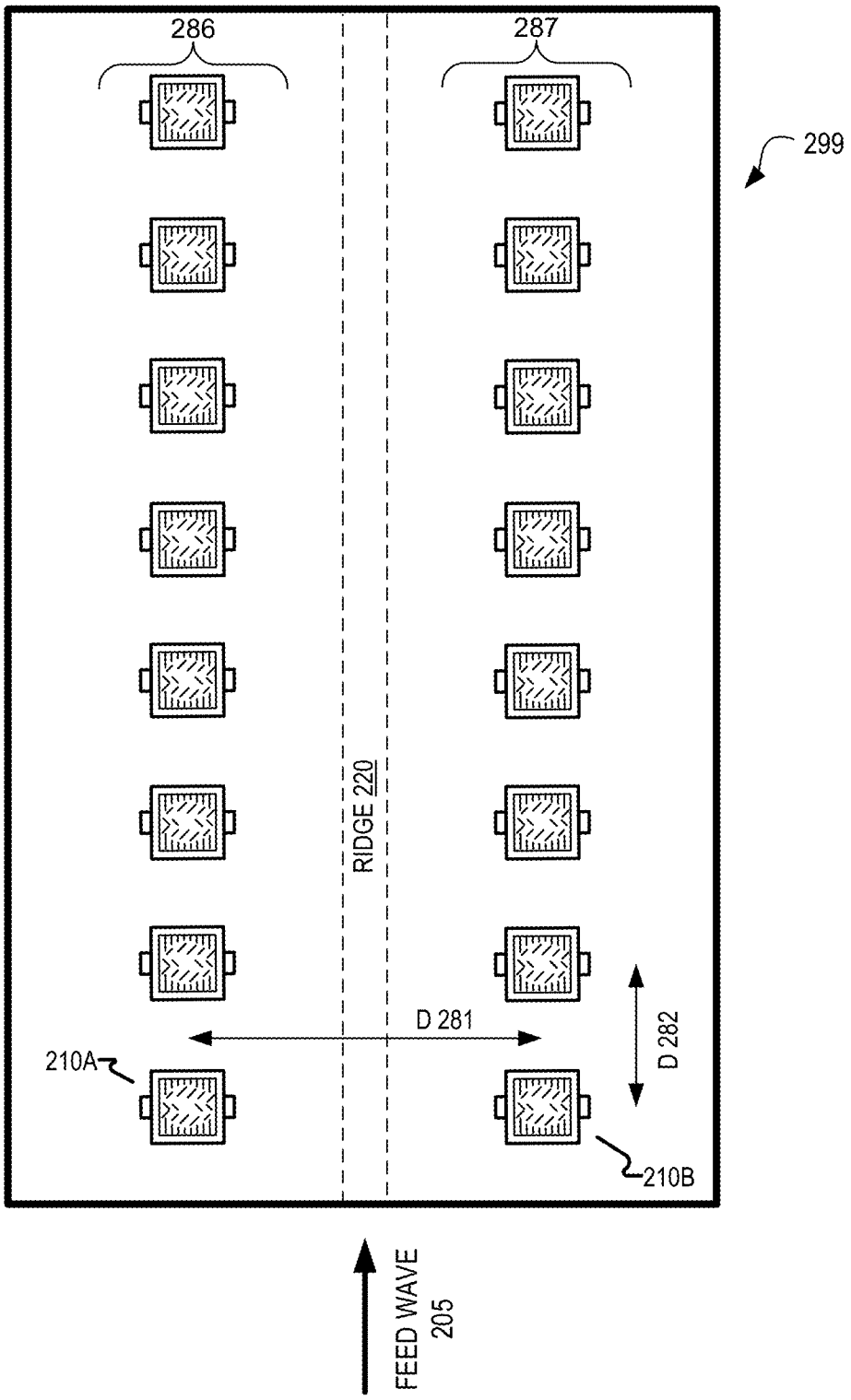

FIG. 2D illustrates a plan view of reconfigurable holographic antenna 299, in accordance with an embodiment of the disclosure. In FIG. 2D, a 2×8 array of tunable slots 210 is shown for illustration purposes, although much larger arrays (e.g. 100×100 or more) may be utilized. FIG. 2D shows that ridge 220 runs lengthwise down waveguide 240. In some embodiments, ridge 220 is positioned between a first half 286 and a second half 287 of the array of tunable slots 210. The first half 286 of the array of tunable slots may be spaced from the second half 287 of the array of tunable slots by λ/2, represented by dimension 286, where λ is a wavelength of feed wave 205. Each tunable slot 210 in the first half 286 is spaced from other tunable slots 210 in first half 286 by λ/5, represented by dimension 282. Tunable slots 210 in the first half 286 may be spaced from other tunable slots 210 in first half 286 by between λ/4 and λ/5, in other embodiments. Tunable slots 210 in second half 287 may be spaced from each other similarly. In FIG. 2D, ridge 220 is disposed half way between the first half 286 and the second half 287 of the array of tunable slots 210.

FIGS. 2A-2D shows one example of a reconfigurable holographic antenna that utilizes a waveguide 240 and a metamaterial layer 230 to steer/shape antenna beam patterns. However, other reconfigurable holographic antennas may include surface wave antennas that utilize surface waves and reconfigurable frequency selective surfaces (a reconfigurable layer) to steer/shape antenna beam patterns. Some surface wave antennas rely on applying voltages to electronically tunable capacitors between metal patches to generate holograms, for example. Surface waves antennas have two-dimensional waveguides that confine surface waves rather than the three-dimensional waveguides such as waveguide 240. The processes and methods disclosed may apply to shaping antenna beam patterns on surface wave antenna and reconfigurable holographic metamaterial antennas.

Figure 3:
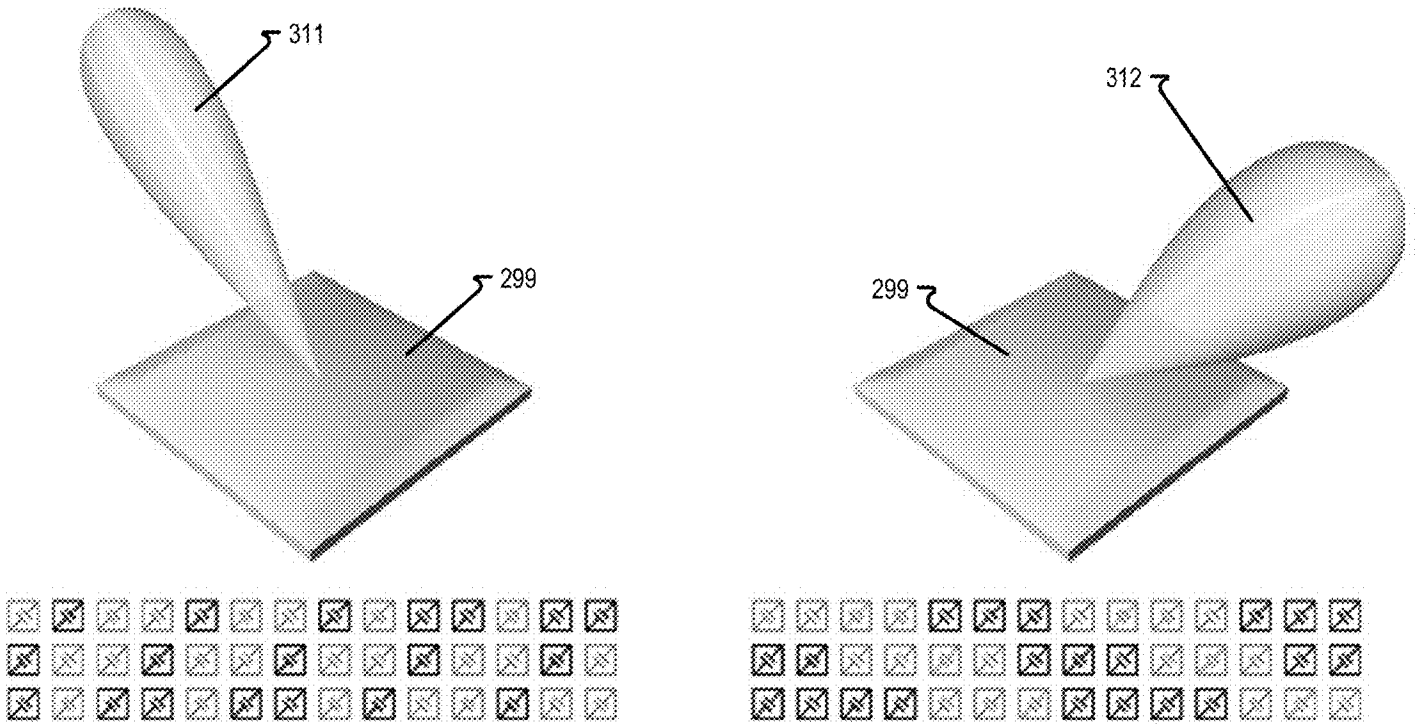
FIG. 3 shows example antenna beams generated by a reconfigurable holographic metamaterial antenna, in accordance with an embodiment of the disclosure.

FIG. 3 shows example antenna beams generated by a reconfigurable holographic metamaterial antenna 299, in accordance with an embodiment of the disclosure. For illustration purposes, on the left side of FIG. 3, a holographic pattern is driven onto an example metamaterial layer that includes a 3×14 array of tunable slots to form a first beam 311. On the right side of FIG. 3, a different holographic pattern is driven onto the 3×14 array of tunable slots to form a second beam 312 that is directed in a different direction than first beam 311.

Figure 4:
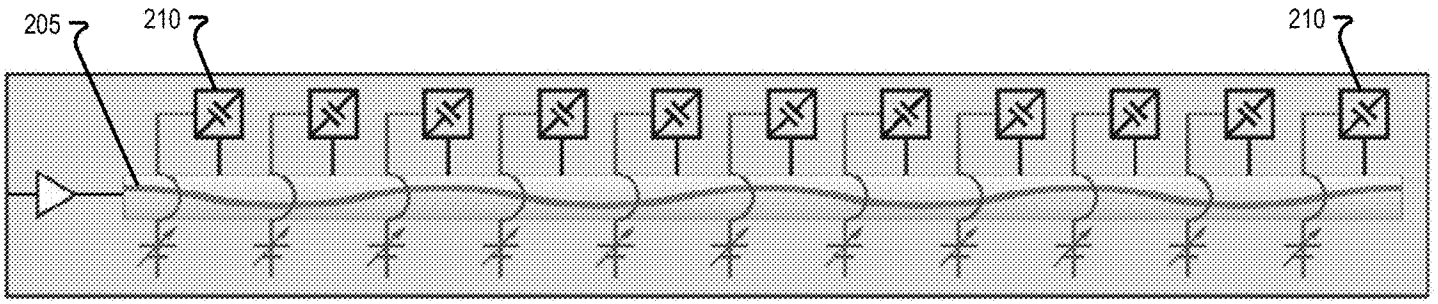
FIG. 4 is an illustration showing tunable resonators affecting a feed wave propagating through a waveguide, in accordance with embodiments of the disclosure.

FIG. 4 is an illustration showing tunable slots 210 affecting a feed wave 205 propagating through a waveguide, in accordance with embodiments of the disclosure. Each tunable slot 210 in an array of tunable slots couples energy out of a feed wave 205 as feed wave 205 propagates through a waveguide. In particular, each tunable slot 210 may influence the amplitude and phase-shift of the beam (e.g. 311 or 312) that is generated by holographic metamaterial antenna 299.

Figure 5A:
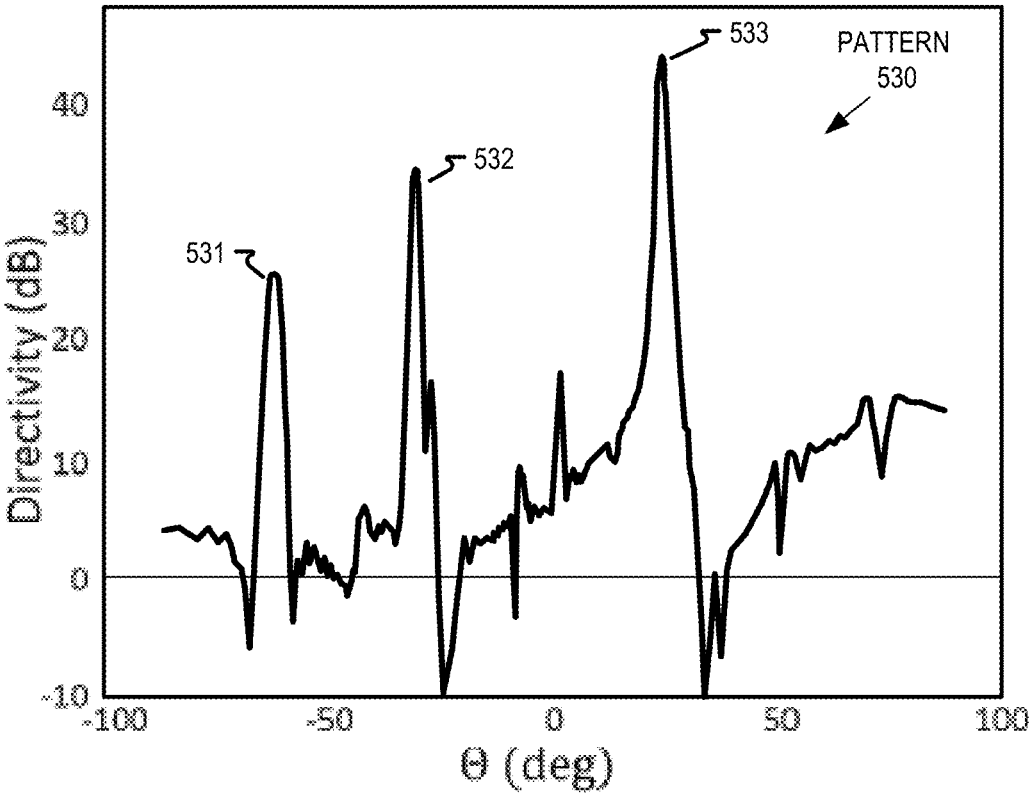
FIGS. 5A and 5B shows a baseline antenna beam pattern that includes a main beam and sidelobes, in accordance with an embodiment of the disclosure.
Figure 5B:
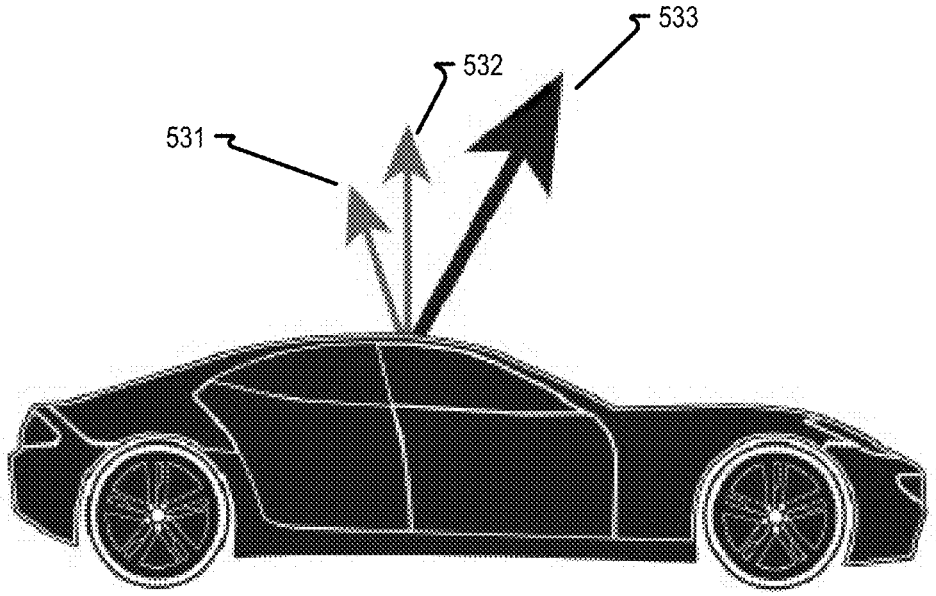

FIGS. 5A and 5B shows a baseline antenna beam pattern 530 that includes main beam 533 and sidelobes 531 and 532, in accordance with an embodiment of the disclosure. Baseline antenna beam pattern 530 is a far-field antenna pattern and for the purposes of this disclosure, reference to antenna beam patterns, beam patterns, and antenna patterns are in reference to far-field antenna radiation patterns, unless otherwise designated. Main beam 533 is directed in the desired direction of communication—toward a satellite, for example. In FIG. 5A, the desired direction of communication is 25.7° θ. To generate baseline beam pattern 530, a baseline holographic pattern is calculated that will, in transmitting mode, direct a feed wave propagating through the waveguide in the desired direction of communication (e.g. toward a satellite). In a receiving mode, a baseline holographic pattern is calculated that will direct a received signal (from a satellite for example) to a receiver coupled to the holographic metamaterial antenna.

In one embodiment, the baseline holographic pattern is recalculated dynamically and driven onto the array of tunable slots as the mobile platform and/or the satellites move to keep up with the changing spatial relationship between the satellite(s) and the reconfigurable holographic antenna. In one embodiment, control module 280 constantly receives location inputs from sensors (e.g. global positioning satellite ("GPS") units) and/or networks (wired or wireless) so that it can properly calculate the interference pattern based on a spatial relationship between the reconfigurable holographic antenna and the satellite. In one embodiment, when a reconfigurable holographic antenna is deployed in a fixed location (e.g. residential context), the holographic diffraction pattern may be calculated less often. The control module 280 may be configured to recalculate the baseline holographic pattern in response to receiving published satellite locations over a network.

Although the calculated baseline holographic pattern may generate a functional baseline antenna beam pattern 530 for communication, baseline antenna beam pattern 530 can be improved to increase communication performance. In particular, sidelobes of the antenna beam pattern 530 could be reduced to improve reception/transmission. Conventional phased array antennas reduce sidelobes by tuning the weights during signal processing, but that approach rests on the assumption that the signal from each antenna element is separable. However, in holographic antennas, that assumption does not apply. Fine tuning beam patterns for holographic metamaterial antennas differs from adjusting the beam patterns in phased array antennas due to the relationship between tunable slots/resonators in the metamaterial layer. More specifically, upstream tunable slots couple energy from feed wave 205 such that downstream tunable slots have less energy exciting them. Additionally, all the tunable slots in the metamaterial layer simultaneously change the feed wave based on the applied holographic pattern and a given tunable slot may affect other tunable slots in close proximity in ways that are difficult to model. In other words, tunable slots 210 are prone to mutual coupling effects where the reactance from one tunable slot can cause unintended energy radiation (or lack thereof) of a proximate tunable slot 210. Furthermore, manufacturing tolerances in the antennas may allow for improving the calculated baseline holographic pattern for the specific antenna. Given these different variables, a method of improving the calculated baseline holographic pattern is desirable.

Figure 5C:
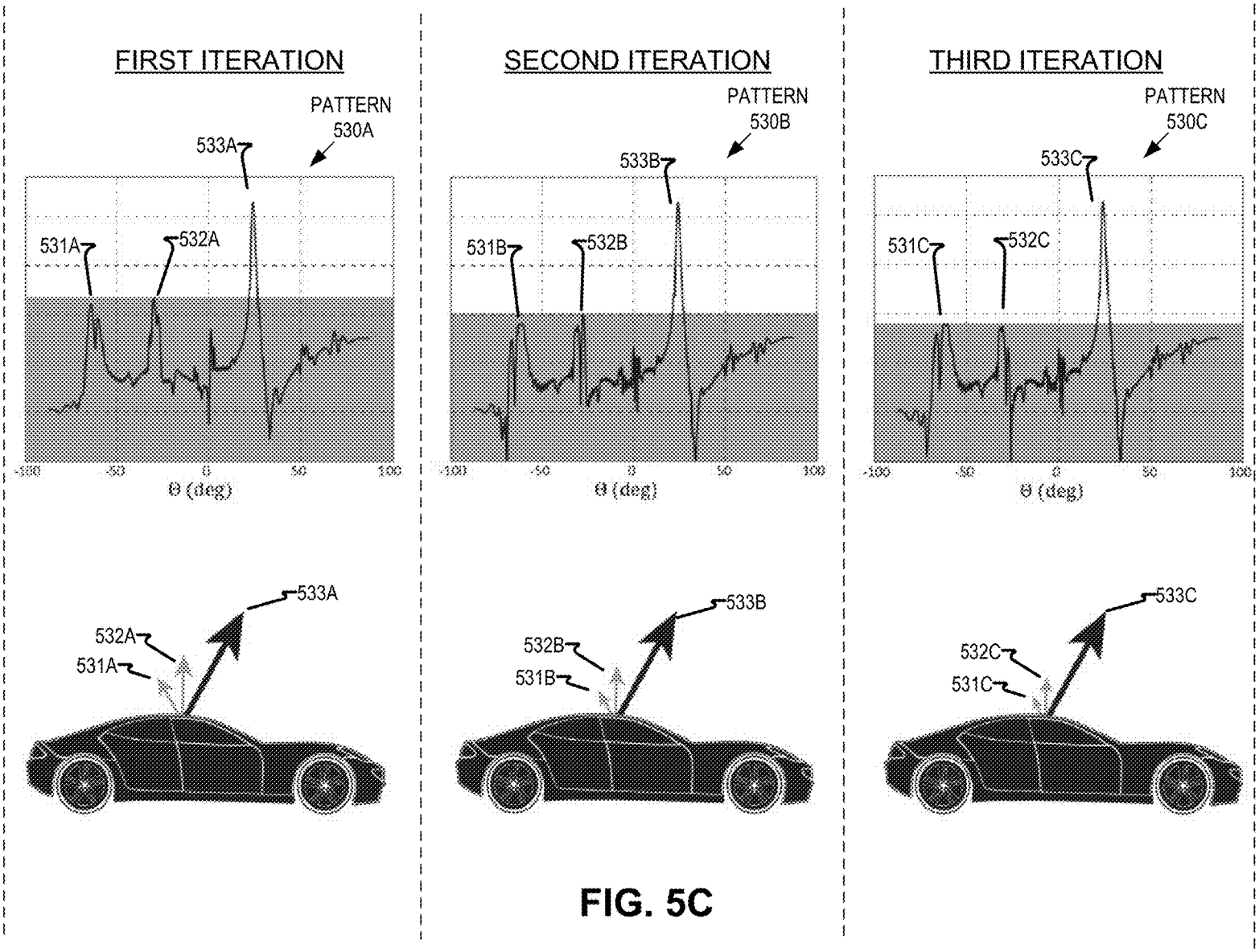
FIG. 5C shows an iterative approach to improving the calculated baseline holographic pattern, in accordance with an embodiment of the disclosure.

FIG. 5C shows an iterative approach to improving the calculated baseline holographic pattern, in accordance with an embodiment of the disclosure. In the first iteration, pattern 530A is an improvement upon pattern 530 in FIG. 5A. Sidelobes 531A and 532A are suppressed when compared to sidelobes 531 and 532. Additionally, the energy previously emitted by sidelobes 531 and 532 has been redirected into main beam 533A. In the second iteration, pattern 530B is an improvement upon pattern 530A and sidelobes 531B and 532B are suppressed when compared to sidelobes 531A and 532A. In the third iteration, pattern 530C is an improvement upon pattern 530B and sidelobes 531C and 532C are suppressed when compared to sidelobes 531B and 532B. The automobiles illustrated under the first, second, and third iterations show that the length (magnitude) of the sidelobes decrease in each iteration and their energy is redirected into main beam 533A-C. Hence, suppressing sidelobes in the antenna beam may strengthen the main beam in addition to reducing the sidelobes that may cause interference. Although, in some cases, a tradeoff of suppressing a sidelobe may come at the expense of the main beam. Shaping the antenna beam to suppress sidelobes is one form of interference mitigation that includes reducing the antenna beam reception or transmission in the direction of an interferer.

Figure 6:
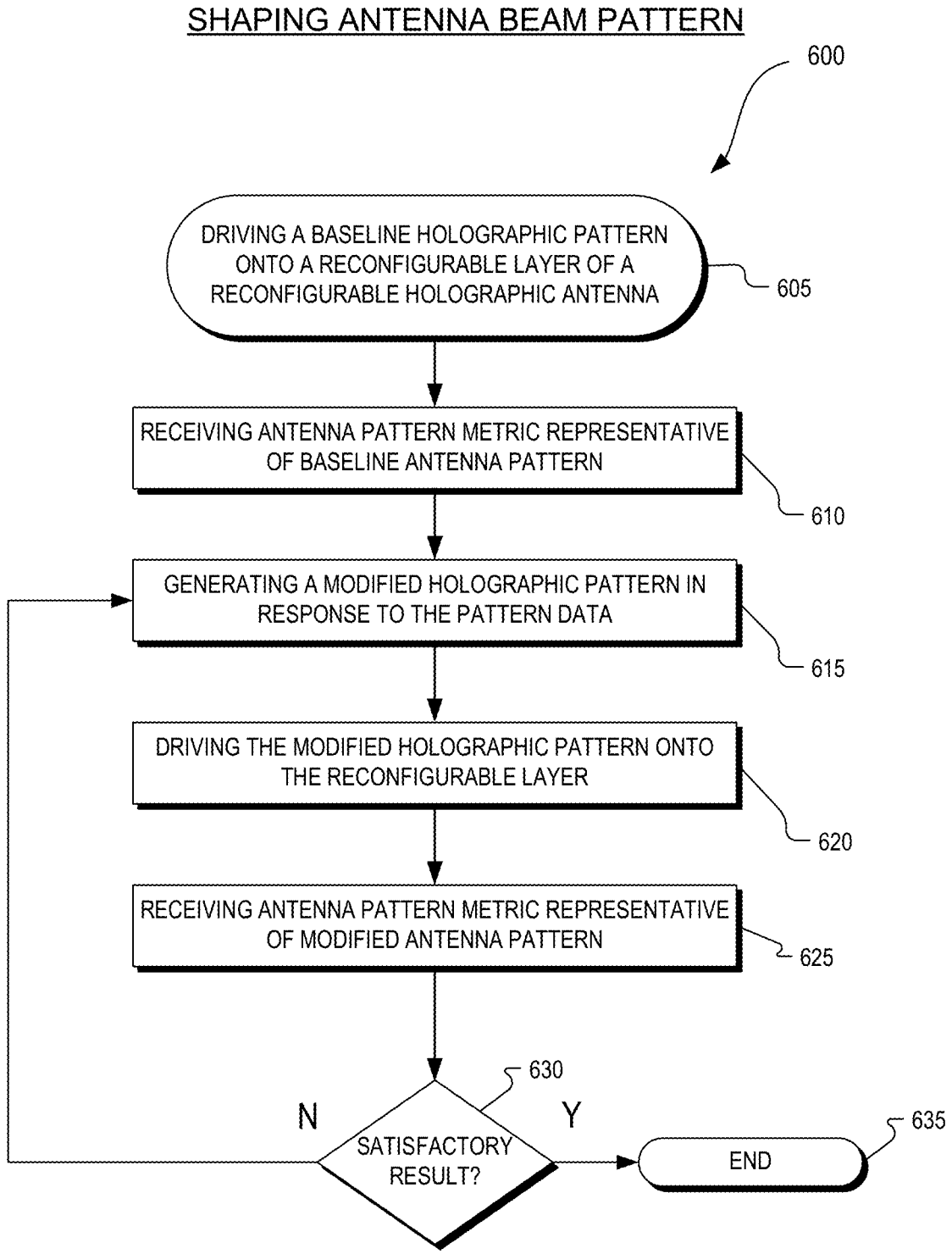
FIG. 6 shows a flowchart that illustrates a process of reducing sidelobes in a holographic antenna, in accordance with an embodiment of the disclosure.

FIG. 6 shows a flowchart that illustrates a process 600 of reducing sidelobes in a holographic metamaterial antenna, in accordance with an embodiment of the disclosure. The order in which some or all of the process blocks appear in process 600 should not be deemed limiting. Rather, one of ordinary skill in the art having the benefit of the present disclosure will understand that some of the process blocks may be executed in a variety of orders not illustrated, or even in parallel.

In process block 605, a baseline holographic pattern is driven onto a reconfigurable layer (e.g. metamaterial layer 230 of a holographic metamaterial antenna 299 or a reconfigurable frequency selective surfaces of a surface wave antenna). In process block 610, an antenna pattern metric representative of a baseline antenna pattern is received (by control module 280, in one embodiment). The antenna pattern metric may come from an actual measurement of the antenna beam with a scanner. The antenna pattern metric may also be (or be derived from) a signal to noise ratio ("SNR"), a signal-to-interference-plus-noise ratio ("SINR"), or a signal-to-interference ratio ("SIR") of a received communication signal, equivalently carrier-to-interference ("C/I"), carrier-to-noise-plus-interference ("C/(N+I)"), or carrier-to-interference ("C/I"). For example, the received communication signal may be a satellite communication signal received by the reconfigurable holographic antenna. In one embodiment, the antenna pattern metric includes a value which is measured as a ratio of energy per bit to noise power spectral density ("Es/No") or measured as a ratio of energy per symbol to noise power spectral density ("Eb/No"). In one embodiment, the antenna pattern metric includes a measured ratio of main beam energy ("desired energy") to sidelobe energy ("undesired energy").

A modified holographic pattern is generated in response to the antenna pattern metric in process block 615 and then that modified holographic pattern is driven onto the reconfigurable layer in process block 620. In process block 625, the antenna pattern metric representative of a modified antenna beam pattern (generated when a feed wave energizes the modified holographic pattern driven onto the reconfigurable layer) is received. Process 600 may return to process block 615 to generate another modified holographic pattern if the antenna pattern metric is unsatisfactory in process block 630. For example, an SNR/SINR, a C/I value, or a main beam to sidelobe ratio below a pre-defined threshold may indicate that the antenna beam needs further refining, while an SNR/SINR, a C/I value, or a main beam to sidelobe ratio above the pre-defined threshold may indicate that the antenna pattern is sufficiently refined.

Figure 8:
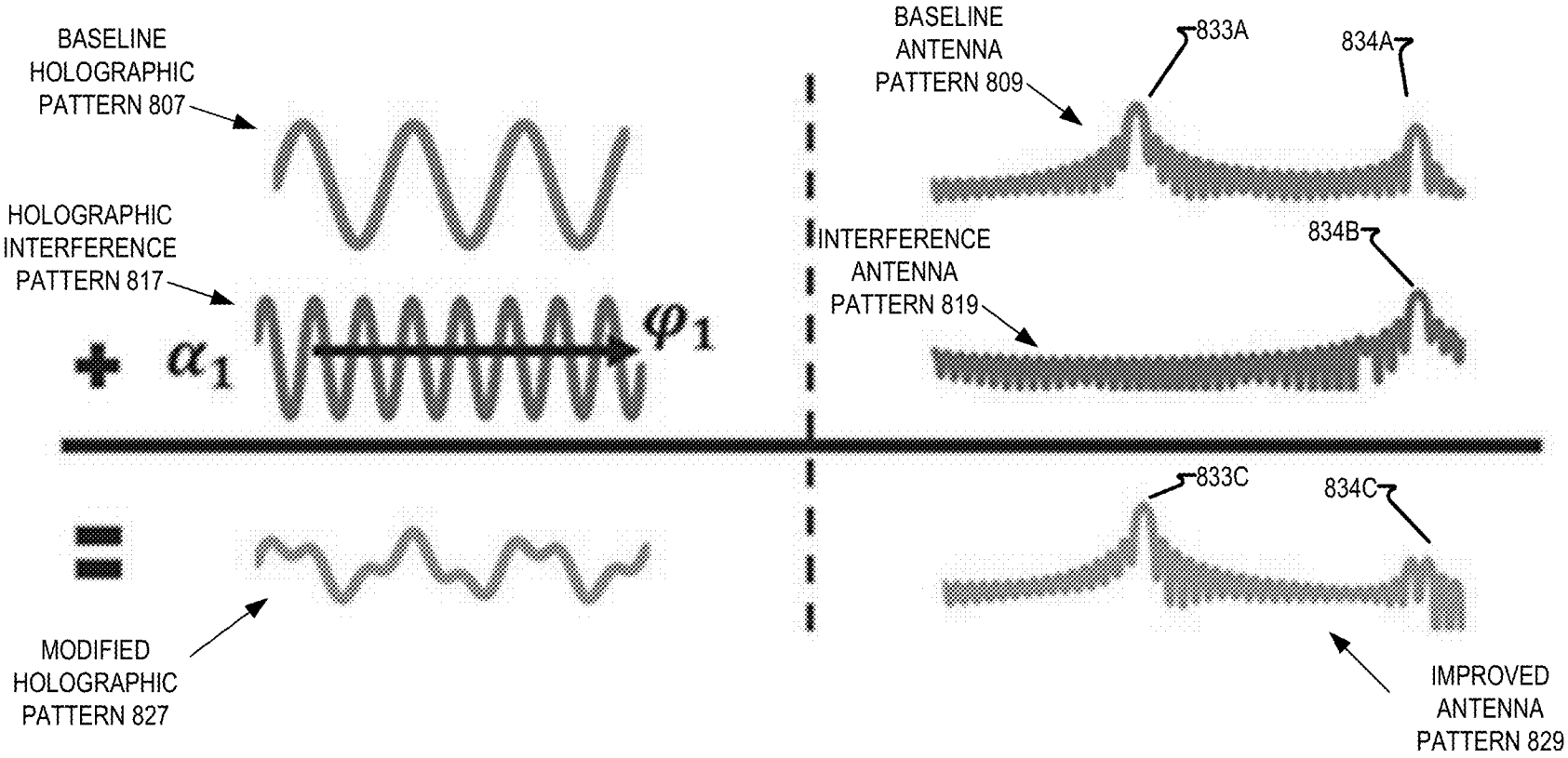
FIG. 8 shows a graphic representation of an example method of generating the modified holographic pattern, in accordance with an embodiment of the disclosure.

FIG. 8 shows a graphic representation of an example method of generating the modified holographic pattern, in accordance with an embodiment of the disclosure. In FIG. 8, baseline holographic pattern 807 represents the calculated baseline holographic pattern that generates a baseline antenna pattern 809 when a feed wave excites the baseline holographic pattern 807 driven onto the reconfigurable layer. Baseline antenna pattern 809 includes a main beam 833A and a sidelobe 834A. In order to reduce/suppress the sidelobe 834A, a holographic interference pattern 817 is added to the baseline holographic pattern 807. If holographic interference pattern 817 was driven onto the metamaterial (and illuminated by a feed wave), it would generate interference antenna pattern 819 having sidelobe 834B, as shown. Sidelobe 834B is at the same scan angle or spatial point as sidelobe 834A. However, as will be discussed in more detail below, sidelobe 834B will be approximately 180° out of phase with sidelobe 834A so that the sidelobes destructively interfere (cancel each other out). Modified holographic pattern 827 is the addition of baseline holographic pattern 807 and holographic interference pattern 817. Consequently, improved antenna pattern 829 is the addition of baseline antenna pattern 809 and interference antenna pattern 819. As shown in FIG. 8, sidelobe 834B being approximately 180° out of phase with sidelobe 834A successfully suppressed sidelobe 834A into sidelobe 834C.

Figure 7:
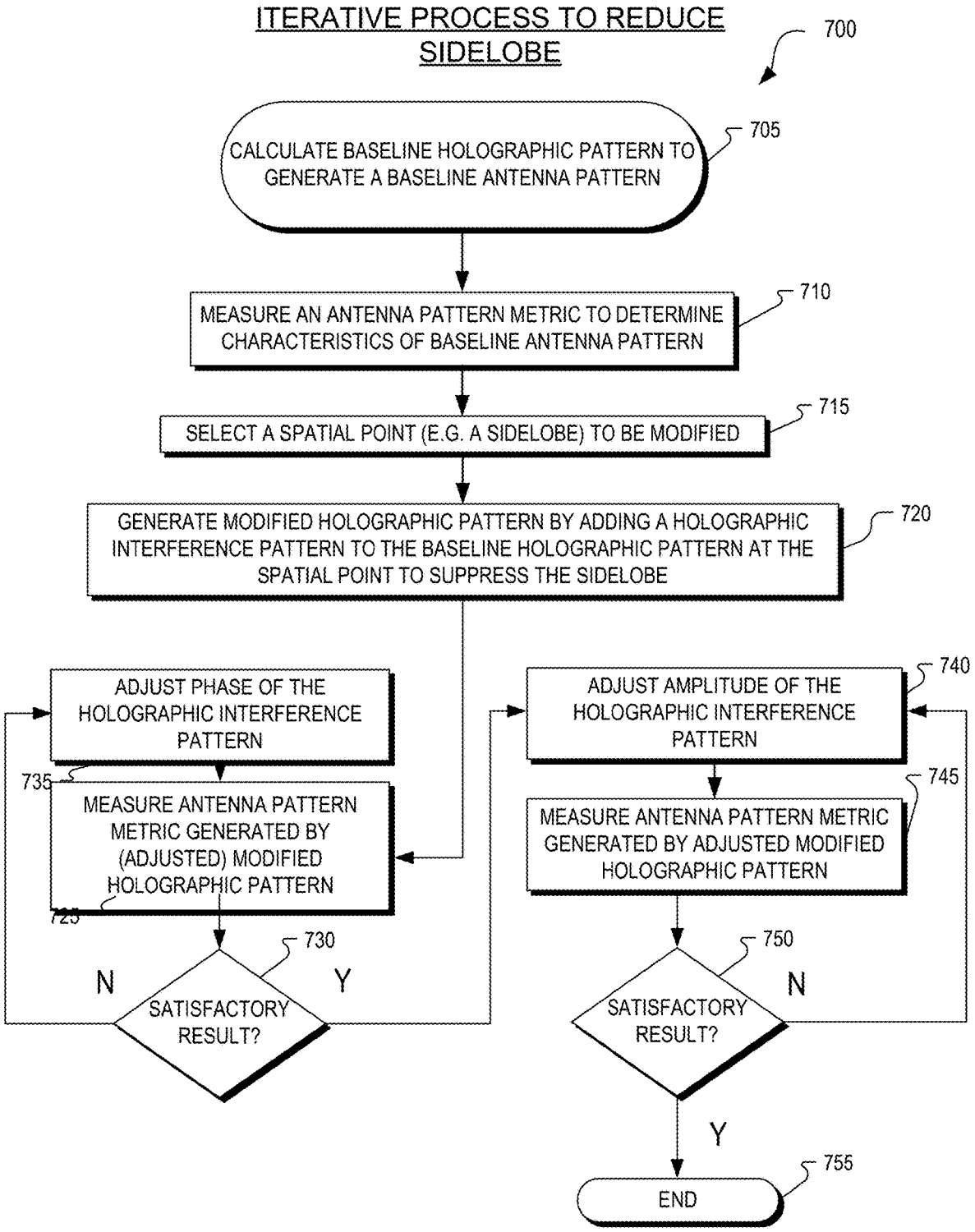
FIG. 7 shows a flowchart that illustrates a process of reducing sidelobes in a holographic antenna, in accordance with an embodiment of the disclosure.

FIG. 7 shows a flowchart that illustrates a process 700 of reducing sidelobes in a reconfigurable holographic antenna, in accordance with an embodiment of the disclosure. The order in which some or all of the process blocks appear in process 700 should not be deemed limiting. Rather, one of ordinary skill in the art having the benefit of the present disclosure will understand that some of the process blocks may be executed in a variety of orders not illustrated, or even in parallel.

In process block 705, a baseline holographic pattern is calculated to generate a baseline antenna pattern. In process block 710, an antenna pattern metric is measured to determine characteristics of the baseline antenna pattern. The antenna pattern metric is obtained by scanning a reconfigurable holographic antenna that is generating the baseline antenna pattern, in one embodiment. The antenna pattern metric is a SNR received by the reconfigurable holographic antenna, in one embodiment. The SNR indicates the reception of a satellite signal by the reconfigurable holographic antenna, in one embodiment. In one embodiment, the SNR indicates the transmission of the reconfigurable holographic antenna to a satellite that is communicated back to the antenna via downlink signal 105 or via a wired or wireless network.

A spatial point is selected to be modified in process block 715. A prominent sidelobe may be selected in order to suppress the sidelobe. The spatial point may be selected in terms of ($\theta$, $\phi$) in a spherical coordinate system. In some contexts, a sidelobe that is directed to, or receptive to, a non-target satellite that is offset from the target satellite by a small angle (e.g. four degrees) may be selected in order to reduce interference from the non-target satellite. In one example, a spatial point that is 2° from the main beam is selected since geo-stationary satellites are often found two degrees apart. Hence, interference is highly likely to be coming from approximately 2° away from the main beam, in some use contexts.

In process block 720, a modified holographic pattern (e.g. 827) is generated by adding a holographic interference pattern (e.g. 817) to the baseline holographic pattern (e.g. 807). The holographic interference pattern targets suppression of the selected spatial point to suppress the sidelobe at the spatial point. In process block 725, the antenna pattern metric is measured while the modified holographic pattern is driven onto the metamaterial layer. If the antenna pattern metric representative of the modified/improved antenna pattern is satisfactory, process 700 continues to process block 740. A satisfactory antenna pattern metric indicates that the phase-offset of the holographic interference pattern is improved enough to be sufficiently optimized, according to a pre-determined threshold. An antenna pattern metric that is satisfactory may be above a pre-determined SNR, for example. In one embodiment, the antenna pattern metric is satisfactory when an interferer (e.g. a non-target satellite) is half the strength of the noise floor of a received signal. In one embodiment, the antenna pattern metric is satisfactory when the interferer is 10% of the noise floor of the received signal. If the antenna pattern metric is not satisfactory (not sufficiently optimized), process 700 continues to process block 735 where the phase-offset is adjusted. The phase-offset adjustment may be adjusted from a starting point of 180° out of phase with the sidelobe of the baseline holographic pattern and be adjusted from there. After the phase-offset of the holographic interference pattern is adjusted in process block 735, an antenna pattern metric generated in response to the adjusted modified holographic pattern is measured in process block 725. Process 700 adjusts the phase-offset of the holographic interference iteratively until a satisfactory result is achieved in process block 730 and the process continues to process block 740.

In process block 740, the amplitude of the holographic interference pattern is adjusted. The antenna pattern metric generated by the amplitude adjusted modified holographic pattern is measured in process block 745. If the antenna pattern metric representative of the modified/improved antenna pattern is satisfactory, process 700 ends at process block 755 or (not illustrated) continues back to process block 705. If the antenna pattern metric is not satisfactory, process 700 returns to process block 740 for further adjustment of the amplitude of the holographic interference pattern. Process 700 adjusts the amplitude of the holographic interference iteratively until a satisfactory result is achieved in process block 750. In one embodiment, the amplitude of the holographic interference pattern starts at a scaling factor of 0.2 of the amplitude of the main beam of the baseline antenna pattern and be iteratively adjusted as needed. Final scaling factors are from 0.02 to 0.2, in one embodiment.

Iterative adjustment of the phase offset and amplitude can be efficiently optimized according to a live gradient descent. In one embodiment of a gradient descent, the phase offset and amplitude have pre-determined starting points (e.g. 180° and 0.02) and then additional sample points are gathered by measuring the antenna pattern metric. With the additional sample points, the algorithm can converge on a phase offset and an amplitude value that significantly improves the modified holographic pattern to yield an improved antenna pattern.

Figure 9:
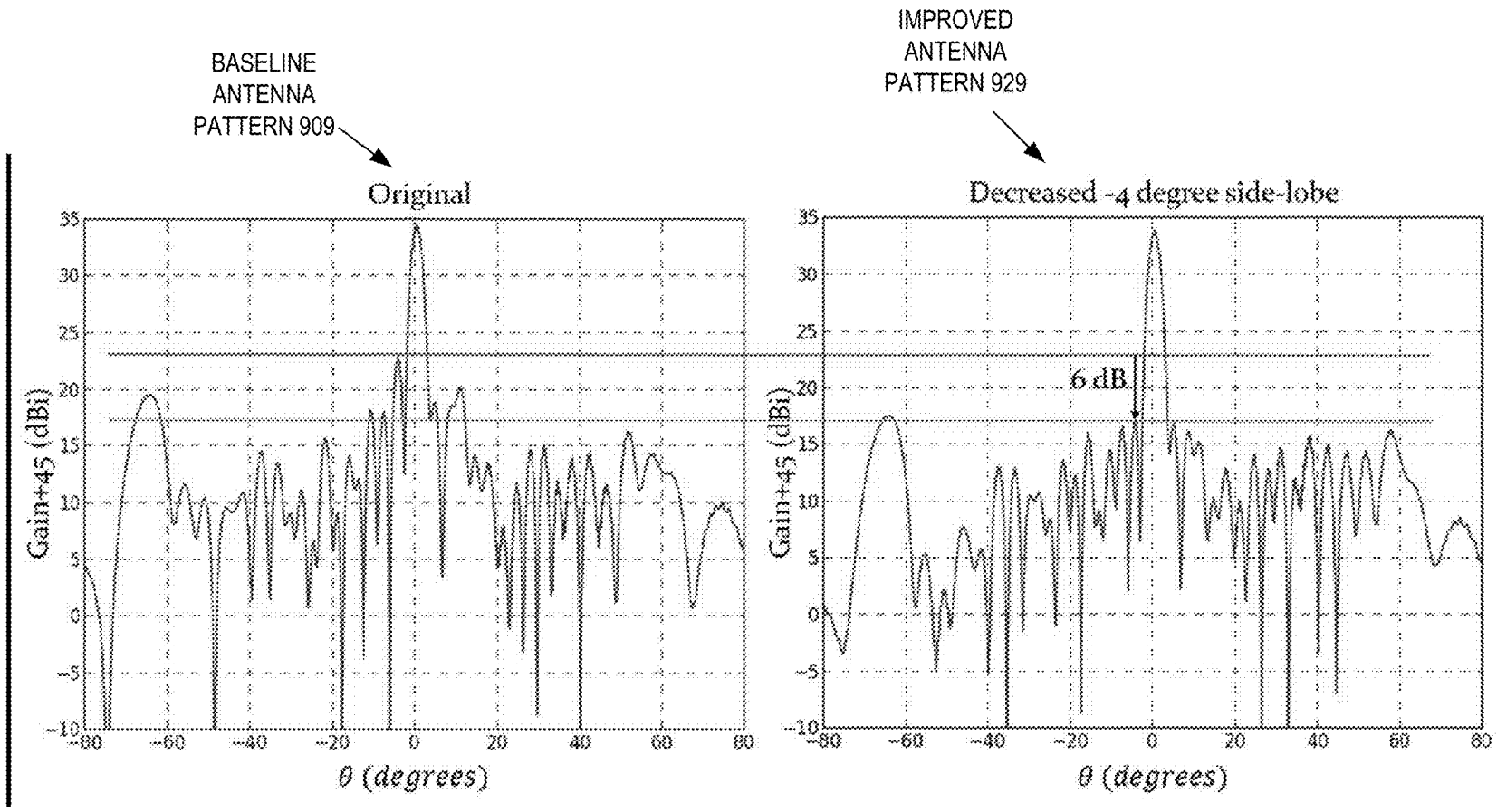
FIG. 9 shows an example baseline antenna pattern and an improved/modified antenna pattern that resulted from the process shown in FIG. 7, in accordance with an embodiment of the disclosure.

FIG. 9 shows an example baseline antenna pattern 909 and an improved/modified antenna pattern 929 that resulted from process 700. In the improved antenna pattern 929, the sidelobe four degrees to the left of the main beam was reduced by 6 dB when compared with baseline antenna pattern 909.

Figure 10:
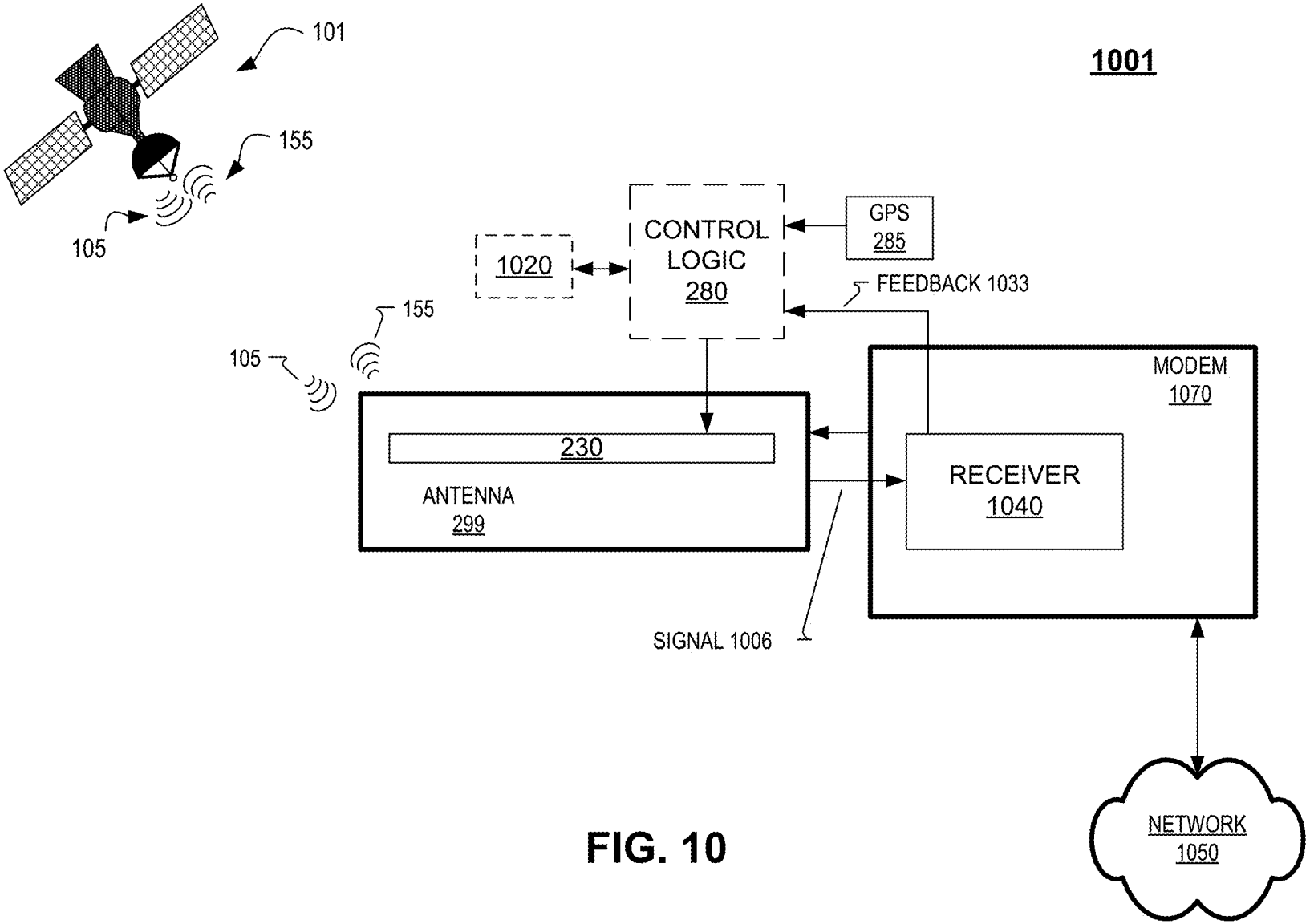
FIG. 10 shows a block diagram of a system that includes a holographic metamaterial antenna, in accordance with an embodiment of the disclosure.

FIG. 10 shows a block diagram of a system 1001 that includes a holographic metamaterial antenna 299, in accordance with an embodiment of the disclosure. System 1001 includes antenna 299, modem 1070, network 1050, satellite 101, memory 1020, control logic 280, and GPS unit 285. Control logic 280, memory 1020, and GPS unit 285 may be included in a holographic metamaterial antenna or in modem 1070. Alternatively, modem 1070 and antenna 299 may be integrated into a single device. The instructions for processes 600 and/or 700 may be stored in memory 1020 which is coupled to control logic 280. Control logic may access machine-readable instructions (code) from memory 1020 and/or write data (e.g. antenna pattern metric) to memory 1020. Control logic is coupled to receive GPS data from GPS receiver unit 285, in FIG. 10. Control logic 280 is also coupled to receive feedback 1033 from receiver 1040. Metamaterial antenna 299 may receive downlink signal 105 from satellite 101. Control logic 280 drives the improved/modified holographic pattern that was optimized by process 600 or 700 onto metamaterial layer 230. Metamaterial layer 230 along with waveguide 240 of antenna 299 (which is dimensioned to efficiently guide the feed wave carrying downlink 105) guides downlink signal 105 to receiver 1040 as signal 1006. The receiver 1040 may be included in antenna 299 or in modem 1070 depending on how the devices are defined. Receiver 1040 may send feedback 1033 to control logic 280 in response to receiving signal 1006. If signal 1006 is strong (has a high SNR), feedback 1033 may indicate to control logic 280 that no modification is needed to the holographic pattern driven onto antenna 299. However, if signal 1006 is weak (low SNR), feedback 1033 may indicate to control logic 280 that the holographic pattern driven onto antenna 299 requires adjustment for improved communication. In this case, the holographic pattern currently driven onto metamaterial layer 230 may be modified by making adjustments (e.g. phase-offset and/or amplitude) to the holographic interference pattern that is added to the baseline calculated holographic pattern. Alternatively, the baseline holographic pattern may be recalculated altogether based on new information such as a change in the GPS coordinates of the antenna or due to new information learned from network 1050. For example, a newly published location of a target satellite may cause control logic 280 to recalculate the baseline holographic pattern and then proceed to optimize the baseline holographic pattern using the techniques discussed above.

The processes explained above are described in terms of computer software and hardware. The techniques described may constitute machine-executable instructions embodied within a tangible or non-transitory machine (e.g., computer) readable storage medium, that when executed by a machine will cause the machine to perform the operations described. Additionally, the processes may be embodied within hardware, such as an application specific integrated circuit ("ASIC") or otherwise.

A tangible non-transitory machine-readable storage medium includes any mechanism that provides (i.e., stores) information in a form accessible by a machine (e.g., a computer, network device, personal digital assistant, manufacturing tool, any device with a set of one or more processors, etc.). For example, a machine-readable storage medium includes recordable/non-recordable media (e.g., read only memory (ROM), random access memory (RAM), magnetic disk storage media, optical storage media, flash memory devices, etc.).

The above description of illustrated embodiments of the invention, including what is described in the Abstract, is not intended to be exhaustive or to limit the invention to the precise forms disclosed. While specific embodiments of, and examples for, the invention are described herein for illustrative purposes, various modifications are possible within the scope of the invention, as those skilled in the relevant art will recognize.

These modifications can be made to the invention in light of the above detailed description. The terms used in the following claims should not be construed to limit the invention to the specific embodiments disclosed in the specification. Rather, the scope of the invention is to be determined entirely by the following claims, which are to be construed in accordance with established doctrines of claim interpretation.

What is claimed is:

1. A method of shaping an antenna beam pattern of an antenna, the method comprising:

driving a first holographic pattern onto a layer of the antenna while a feed wave excites the layer;

receiving an antenna pattern metric representative of a first antenna pattern generated by the antenna while the first holographic pattern is driven onto the layer;

generating a modified holographic pattern in response to the antenna pattern metric; and driving the modified holographic pattern onto the layer of the antenna.

2. The method of claim 1, wherein generating the modified holographic pattern in response to the antenna pattern metric includes:

selecting coordinates of a sidelobe of the first antenna pattern; and adding a holographic interference pattern to the first holographic pattern, the holographic interference pattern to cancel at least a portion of the sidelobe.

3. The method of claim 2, wherein generating the modified holographic pattern in response to the antenna pattern metric further includes one or more of:

adjusting a phase-offset of the holographic interference pattern; and adjusting an amplitude of the holographic interference pattern.

4. The method of claim 1 further comprising:

generating the antenna pattern metric based on a measurement of a signal-to-noise ratio ("SNR") of a signal received by the antenna.

5. The method of claim 1 further comprising:

generating the antenna pattern metric based on a measurement of the first antenna pattern.

6. The method of claim 1, wherein the layer is a metamaterial layer that includes an array of slots configurable to form holographic diffraction patterns for steering the feed wave.

7. The method of claim 6, wherein each of the slots in the array of slots comprises:

an iris;

a radiating patch co-located with the iris; and a tunable dielectric is disposed between the iris and the radiating patch.

8. The method of claim 6, wherein driving the first holographic pattern and modified holographic pattern onto the layer includes tuning a reactance of each of the slots of the metamaterial layer by varying a voltage across liquid crystal disposed within each of the slots.

9. The method of claim 1, wherein the feed wave is received from a satellite.

10. The method of claim 1, wherein the feed wave is provided by the antenna.

11. The method of claim 1 further comprising:

generating the antenna pattern metric based on a measurement of a Carrier-to-Interference ("C/I") value of a signal received by the antenna.

12. A holographic metamaterial antenna comprising:

a waveguide;

a metamaterial layer coupled to the waveguide;

control logic coupled to drive holographic patterns onto the metamaterial layer; and a non-transitory machine-readable medium that provides instructions that, when executed by the holographic metamaterial antenna, will cause the holographic metamaterial antenna to perform operations comprising:

driving a first holographic pattern onto a layer of the antenna while a feed wave excites the layer;

receiving an antenna pattern metric representative of a first antenna pattern generated by the antenna while the first holographic pattern is driven onto the layer;

generating a modified holographic pattern in response to the antenna pattern metric; and driving the modified holographic pattern onto the layer of the antenna.

13. The holographic metamaterial antenna of claim 12, wherein generating the modified holographic pattern in response to the antenna pattern metric includes:

selecting coordinates of a sidelobe of the first antenna pattern to modify; and adding a holographic interference pattern to the first holographic pattern, the holographic interference pattern to cancel at least a portion of the sidelobe.

14. The holographic metamaterial antenna of claim 13, wherein generating the modified holographic pattern in response to the antenna pattern metric further includes:

adjusting a phase-offset of the holographic interference pattern; and adjusting an amplitude of the holographic interference pattern.

15. The holographic metamaterial antenna of claim 12, wherein the non-transitory machine-readable medium provides further instructions that will cause the holographic metamaterial antenna to perform further operations comprising:

generating the antenna pattern metric based on a measurement of a signal-to-noise ratio ("SNR") of a signal received by the antenna.

16. The holographic metamaterial antenna of claim 12, wherein the metamaterial layer includes an array of slots configurable to form holographic diffraction patterns for steering the feed wave.

17. The holographic metamaterial antenna of claim 16, wherein each of the slots in the array of slots comprises:

an iris;

a radiating patch co-located with the iris; and a tunable dielectric is disposed between the iris and the radiating patch.

18. The holographic metamaterial antenna of claim 16, wherein driving the first holographic pattern and modified holographic pattern onto the metamaterial layer includes tuning a reactance of each of the slots by varying a voltage across liquid crystal disposed within each of the slots.

19. The holographic metamaterial antenna of claim 12, wherein the feed wave is provided by the antenna.

20. The holographic metamaterial antenna of claim 12, wherein the non-transitory machine-readable medium provides further instructions that will cause the holographic metamaterial antenna to perform further operations comprising:

calculating the first holographic pattern in response to a position of the antenna relative to a satellite.

21. A method of interference mitigation for reconfigurable holographic antennas, the method comprising:

driving a first holographic pattern onto a layer of the antenna while a feed wave excites the layer;

receiving an antenna pattern metric representative of a first antenna pattern generated by the antenna while the first holographic pattern is driven onto the layer;

generating a modified holographic pattern in response to the antenna pattern metric; and driving the modified holographic pattern onto the layer of the antenna to generate an adjusted antenna pattern.

* * * * *